US007435149B2

(12) United States Patent
Bastiao

(10) Patent No.: US 7,435,149 B2
(45) Date of Patent: Oct. 14, 2008

(54) AQUATIC GEAR

(76) Inventor: Rui Bastiao, 580 Dillingham Blvd., Honolulu, HI (US) 96817-4601

( * ) Notice: Subject to any disclaimer, the term of this patent is extended or adjusted under 35 U.S.C. 154(b) by 0 days.

(21) Appl. No.: 11/686,428

(22) Filed: Mar. 15, 2007

(65) Prior Publication Data

US 2007/0238374 A1 Oct. 11, 2007

Related U.S. Application Data

(60) Provisional application No. 60/791,367, filed on Apr. 11, 2006.

(51) Int. Cl.
*A63B 31/11* (2006.01)

(52) U.S. Cl. ..... 441/61

(58) Field of Classification Search ..... 441/60, 441/61, 62, 64

See application file for complete search history.

(56) References Cited

U.S. PATENT DOCUMENTS

| | | | | |
|---|---|---|---|---|
| 1,480,366 | A * | 1/1924 | Bergerson | 441/60 |
| 1,633,169 | A * | 6/1927 | Feinauer | 441/60 |
| 1,711,307 | A * | 4/1929 | Dabrowski | 441/60 |
| 6,227,923 | B1 * | 5/2001 | Johnson | 441/61 |

* cited by examiner

*Primary Examiner*—Sherman Basinger
(74) *Attorney, Agent, or Firm*—Bourque and Associates

(57) ABSTRACT

A system, method, and device for swimming and physical therapy are disclosed herein. The exemplary gear may have a foot portion adapted to receive a foot of a user and a lateral fin extended from the foot portion in a direction away from the heel opposite a toe of the foot. One or more rear side fins may extend from a side edge of the lateral fin to the foot portion in a plane that intersects the lateral fin the foot portion. Embodiments may incorporate additional side fins and extension fins as well as other aspects.

20 Claims, 16 Drawing Sheets

AQUATIC GEAR

CROSS-REFERENCE TO RELATED APPLICATIONS

This application claims priority to U.S. patent application Ser. No. 60/791,367 filed Apr. 11, 2006 entitled Cycle Fin, which is incorporated fully herein by reference.

TECHNICAL FIELD

The present invention relates to aquatic gear and more particularly, relates to aquatic footwear for recreational swimming/paddling and physical therapy.

BACKGROUND INFORMATION

Flippers may be worn on the feet of paddlers. The flippers provide a fin that extends from the foot to allow the swimmer to use the motion of their feet to propel a greater amount of water. This provides the swimmer more power and speed in the water. The swimmer kicks their feet in a back and forth motion and glides through the water in the direction parallel with the swimmer torso.

The flippers couple to the foot of the user just below the ankle of the swimmer's foot. Flexible material wraps around the foot and holds the fins to the swimmer's foot. The fins extend out from the foot portion in the direction of the user's toes. As the foot moves back and forth in the water the front and back surfaces of the fin push the water. The fins provide a greater surface area for the foot to push water.

The flippers are designed to move through the water in a direction parallel with the torso of the swimmer. The flippers use specific muscles and may not strengthen other muscles. Accordingly, a need exists for a device and method of using that allows the user to utilize the device in a relaxing position. The attributes may need to allow the user to exercise various muscle groups. The attributes also may need to allow modification to the flipper to increase the intensity or propulsion forces of the swim in a specific direction. The attributes also may need to allow the flipper to provide increase stability of the swimmer in a lateral direction of the swimmer's torso.

SUMMARY

It is, therefore, an objective of the present invention to provide devices, systems, and methods for recreational swimming/paddling and physical therapy. The invention allows a user to be propelled in the water using a cycling motion paddling motion of the user's feet (similar to paddling a bicycle) while sitting in the water. The user may be supported by a float and cruise in a forward direction for recreational use, bringing more enjoyment and fun in the water. The invention may also be used for fitness, helping to increase muscle speed and strength in the lower extremities. The invention may also be used in therapeutic services by assisting in physical therapy for the rehabilitation of the user's lower extremities with non-jarring aquatic exercises.

According to an exemplary embodiment of the present invention, the exemplary aquatic gear for a user's feet may have a foot portion adapted to receive a foot of a user and a lateral fin extended from the foot portion in a direction away from the heel opposite a toe of the foot. One or more rear side fins may extend from a side edge of the lateral fin to the foot portion in a plane that intersects the lateral fin of the foot portion.

Exemplary embodiments may incorporate one or more of the following embodiments. In one embodiment, the rear side fin may be made of a flexible material and coupled to the foot portion. The lateral fin portion may cause the rear side fin to flex when under compression and to be taut when under tension. In another exemplary embodiment, the foot portion receives a heel and may have one or more straps for coupling to an ankle/shin portion of the foot. In another embodiment, one or more removable side accessory fins may extend from the foot portion in plane that is substantially perpendicular with a leg of the foot and a bottom surface of the foot. In another embodiment the lateral and side fins may have apertures/vents that passes through the fin and allow the flow of water during use. In yet another embodiment, a removable extension rear fin accessory may couple to the lateral fin and extends in a plane substantially parallel to the lateral fin.

BRIEF DESCRIPTION OF THE DRAWINGS

These and other features and advantages of the present invention will be better understood by reading the following detailed description, taken together with the drawings wherein.

DETAILED DESCRIPTION

The aquatic gear described in the following exemplary embodiment may be used for recreational swimming and/or physical therapy purposes. The aquatic gear is worn on the feet of the user and allows the user to maneuver through the water using a paddling motion of the user's legs. The aquatic gear, as will be sold under the trademark Profin, may be used while the swimmer remains in a relaxing, reclined seated position within the water. The aquatic gear also provides lateral stability as the user paddles. Additional fins may be added to the aquatic gear to increase the intensity and/or provided greater and/or different motion.

Figure 1A:
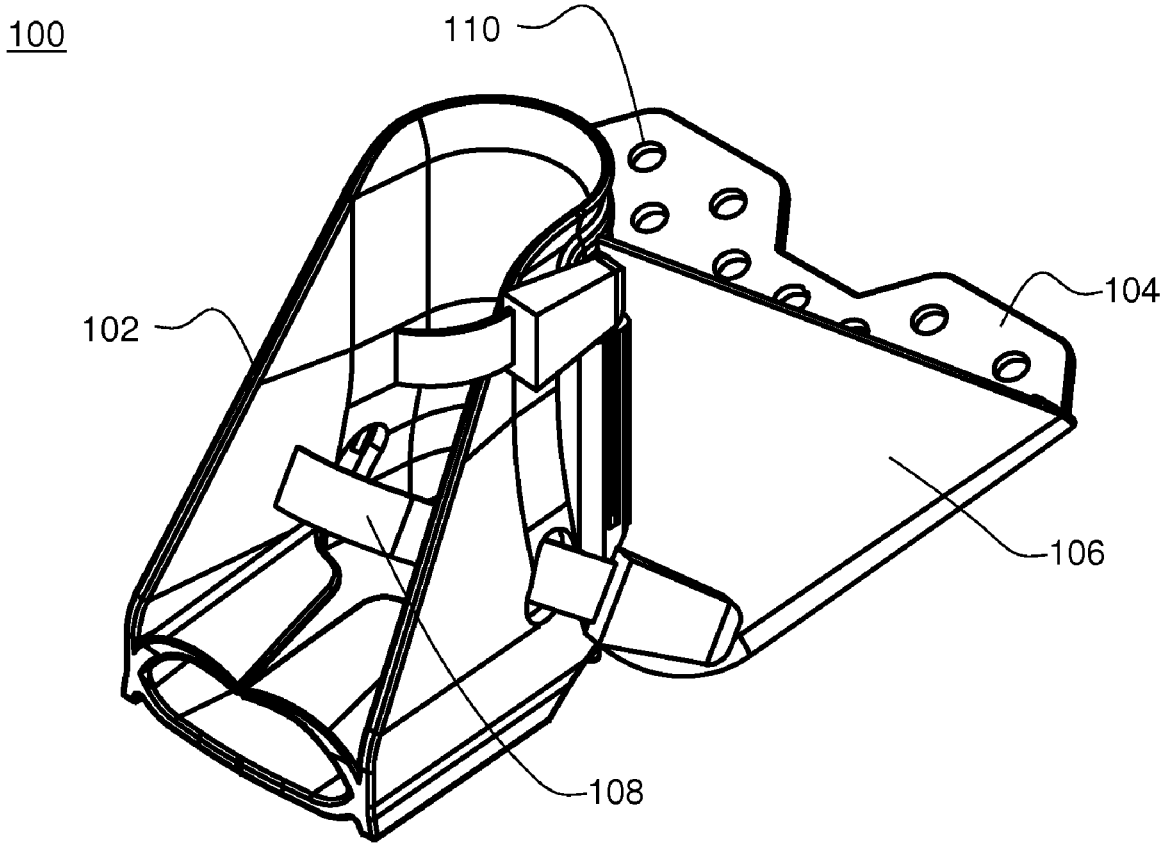
FIGS. 1A and 1B are a front and back perspective illustrating a first fin exemplary embodiment according to the present invention.
Figure 1B:
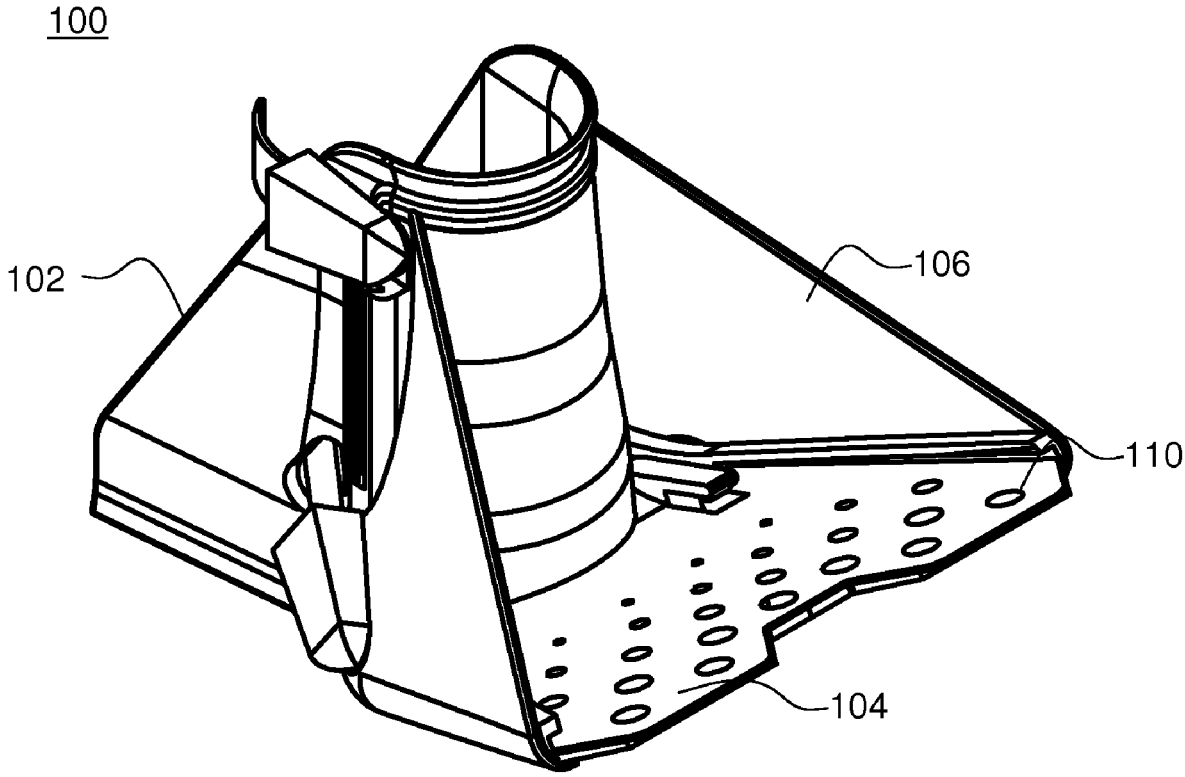
Figure 2A:
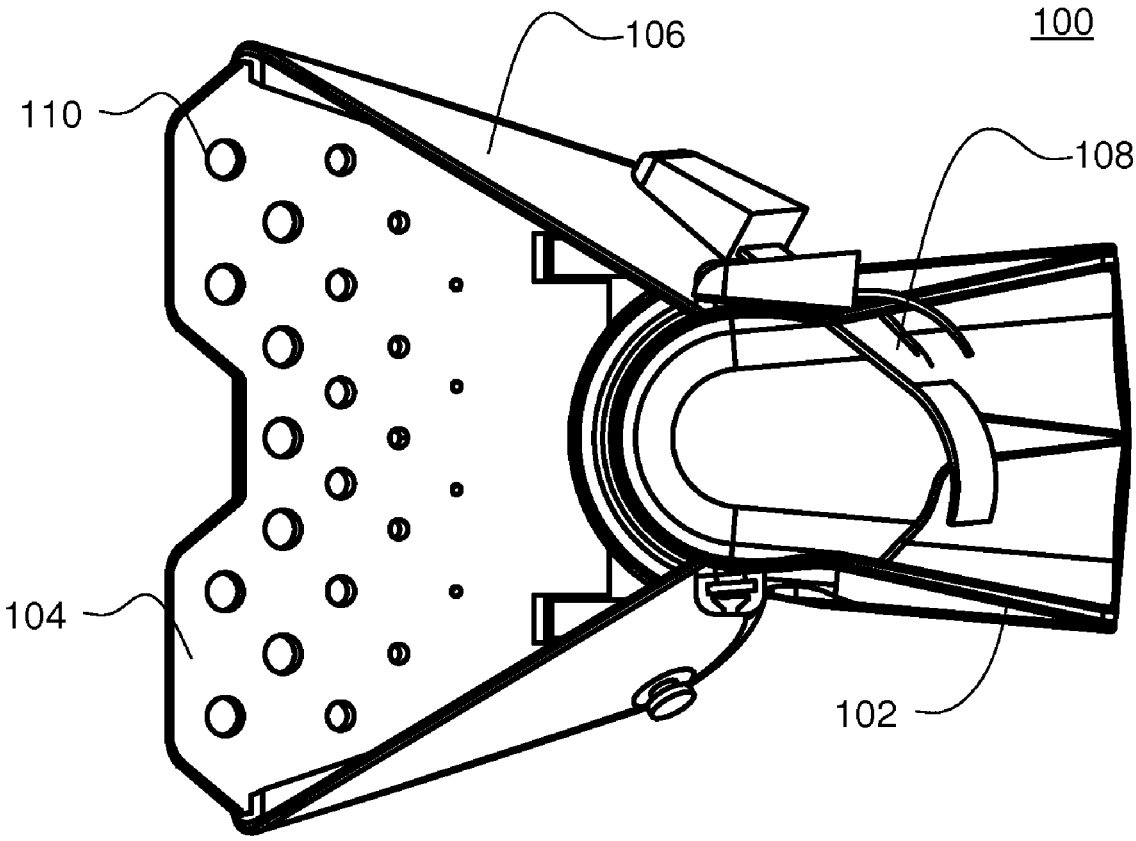
FIGS. 2A, 2B, and 2C are a top, side and bottom profile illustrating the first fin exemplary embodiment according to the present invention.
Figure 2B:
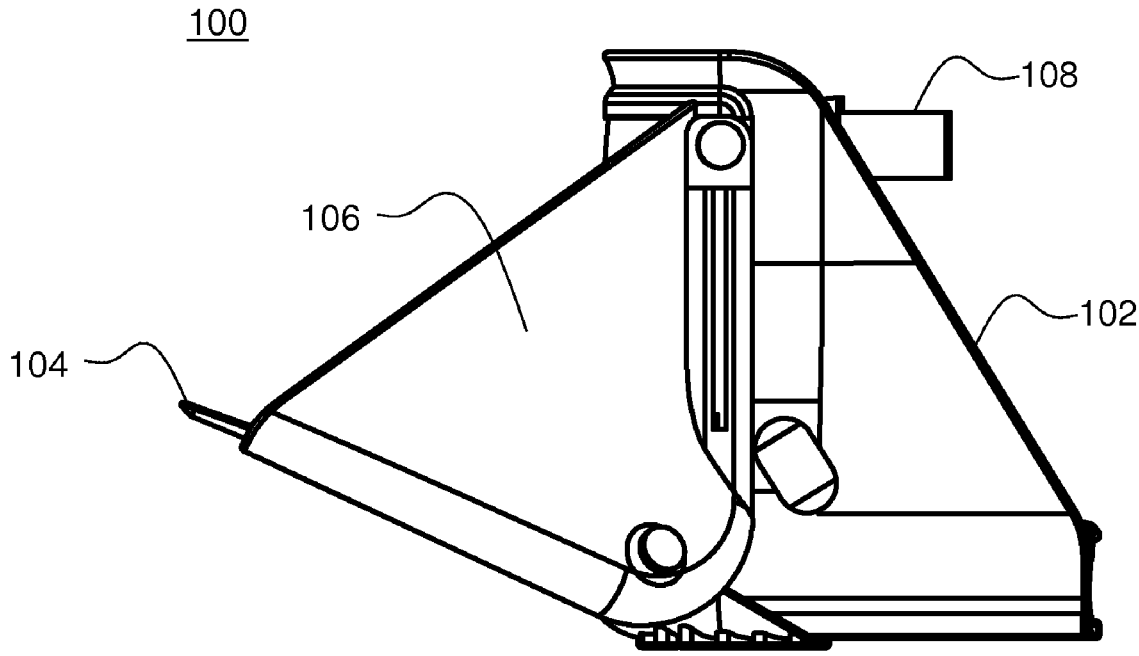
Figure 2C:
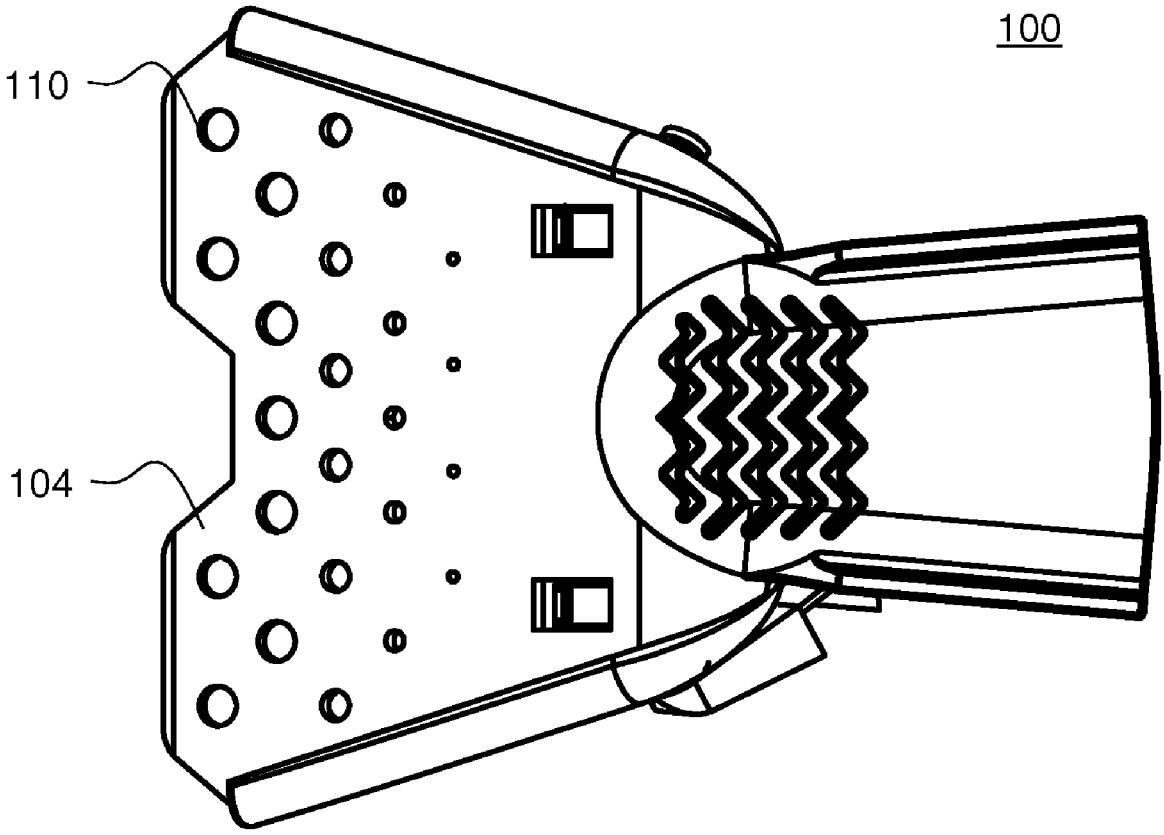

Referring to FIGS. 1 and 2, a first exemplary embodiment 100 has a foot portion 102 for receiving the foot of a user. The user's foot is positioned within the sidewalls of the foot portion. The toes of the foot may extend out the front of the foot portion 102. The foot portion 102 may be a flexible rubber/plastic that are sized according to the user's foot, for example, the foot portion 102 may be manufactured in a range of sizes. Adjustable straps 108 may be used to secure the foot within the foot portion 102. The straps 108 may be loosened or disconnected from either end to allow the insertion of the user's foot. Once the foot is inserted the straps 108 may be reconnected or tightened to secure the foot within the foot portion 102. The adjustable straps 108 may comprise, for example, an upper strap to secure around the shin of the user's foot and a lower strap to secure around the ankle of the user's foot. The aquatic gear is not limited to the previously described strap configuration. The strap configuration may use any number of straps with various widths and shaping or not straps at all.

The foot portion 102 is not limited to prior heel/shin and ankle configuration. The foot portion 102 may be designed to house the entire foot of the user. In another example the foot portion 102 maybe designed simply to wrap around the ankle/shin of the user. The foot portion 102 may also incorporate other features, for example, the heel surface may incorporate treading to provide additional traction in and out of the water. In another example, the foot portion 102 may include handles (not shown in the figures) to aid in the user with inserting or removing the foot.

A lateral fin 104 extends from about the bottom of the foot portion 102 in a direction away from a heel region of the foot portion. The lateral fin 104 may be at a slightly upward angle from the plane of the bottom surface of the user's foot. The lateral fin 104 maybe made of a semi-rigid rubber/plastic material. The lateral fin 104 may have apertures and other vents 110 that allow water to flow through during paddling. The size of the apertures/vents 110 may be designed based on the desired force applied by the user to the water. For example, increasing the amount and size of vents would decrease the strength required to move the fin through the water but also decrease the amount of water displaced and therefore the force that propels the user.

Rear side fins 106 couple the outer edges of the lateral fin 104 to the foot portion 102. The rear side fins 106 form triangular shaped walls that support the lateral fin 104. The force as the lateral fin 104 is pushed/pulled through water is transferred from the lateral fin 104 to the foot portion 102 and the leg/foot of the user. The rear side fins 106 may be used to provide additional structural support as the user pushes/pulls the lateral fin 104 through the water. In addition to providing structure to the lateral fin 104, the rear side fins 106 provide a horizontal fin that increases the stability of the user as the user paddles. The increase stability allows the user to remain in a relaxed seated position. The rear side fins 106 may be made of a semi-rigid or flexible material.

The rear side fins 106 may be designed to bow when force is applied to the bottom of the lateral fin 104. Thereby increase the angle of the lateral fin 104 from the plane of the bottom surface of the user's foot. The increase angle allows the lateral fin 104 to push less water and reduce the strength necessary to push the foot forward through the water when the user is paddling their feet. As the user moves their foot on the return stroke the water pushes on a top surface of the lateral fin 104 and straightens the rear side fins 106, decrease the angle of the lateral fin relative to the bottom surface of the foot. The rear side fins 106, lateral fin 104, and foot portion 102 may produce a pocket that scopes the water on the return stoke. The rear side fins 106 are not limited to bowing. The rear side fins 106 may be designed with flex points or other hinges points that allow for the movement of the lateral fin 104.

Figure 3A:
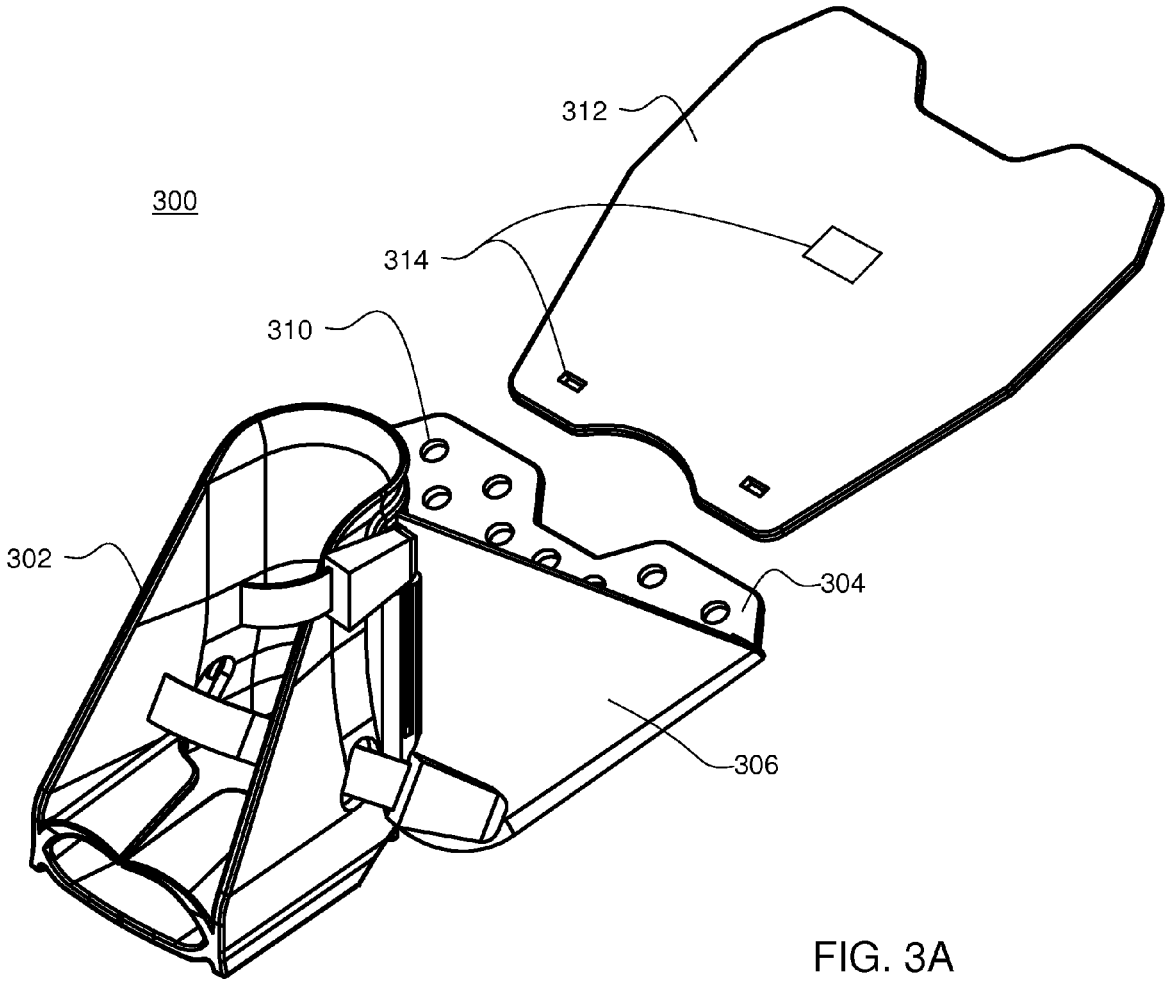
FIGS. 3A and 3B are a front and back perspective illustrating a second rear fin exemplary embodiment according to the present invention.
Figure 3B:
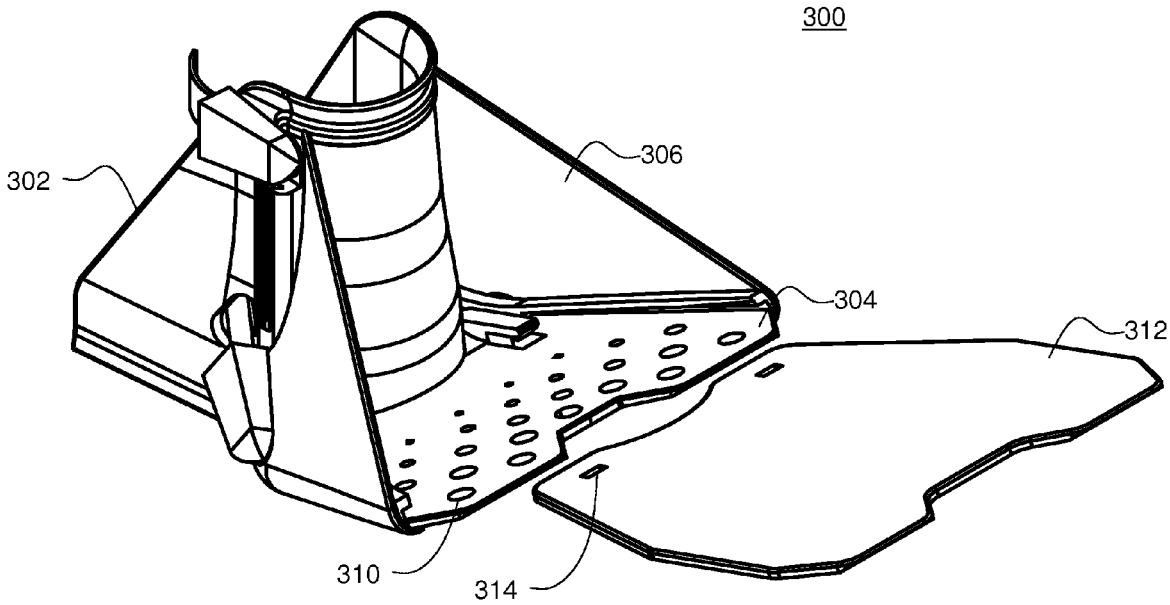
Figure 4A:
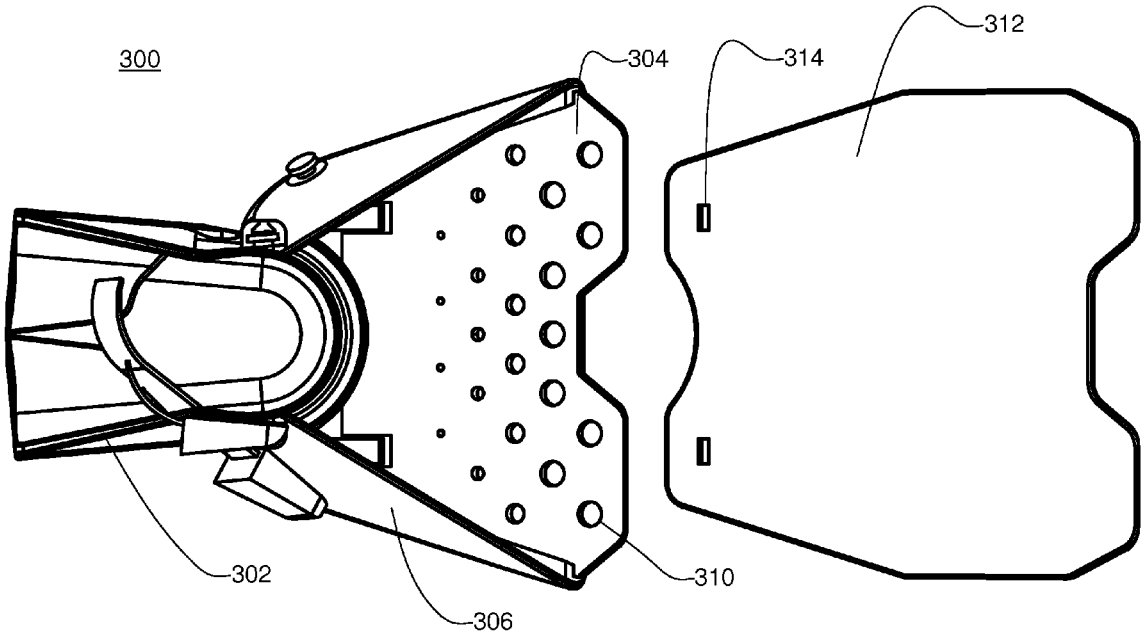
FIGS. 4A, 4B, and 4C are a top, side and bottom profile illustrating the second rear fin exemplary embodiment according to the present invention.
Figure 4B:
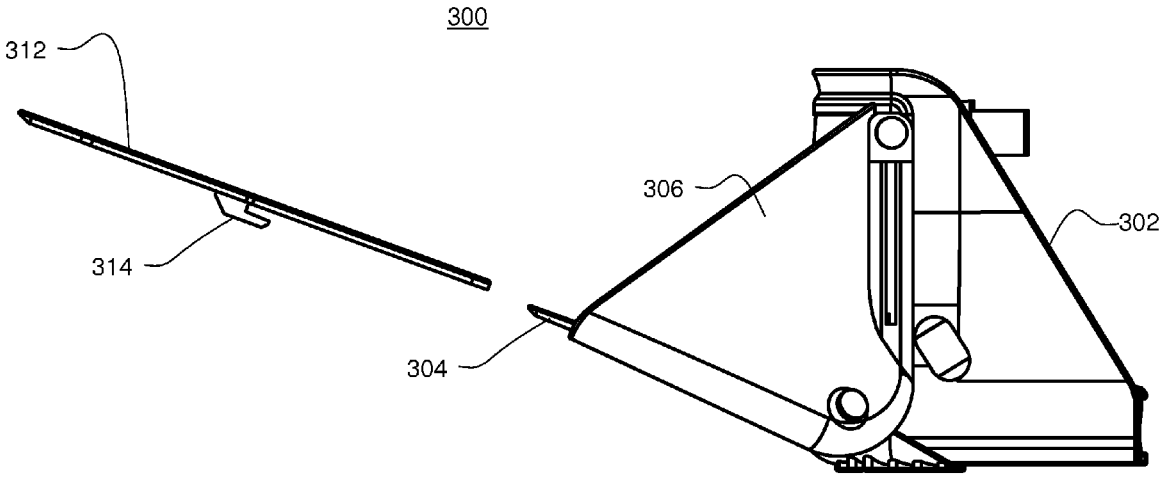
Figure 4C:
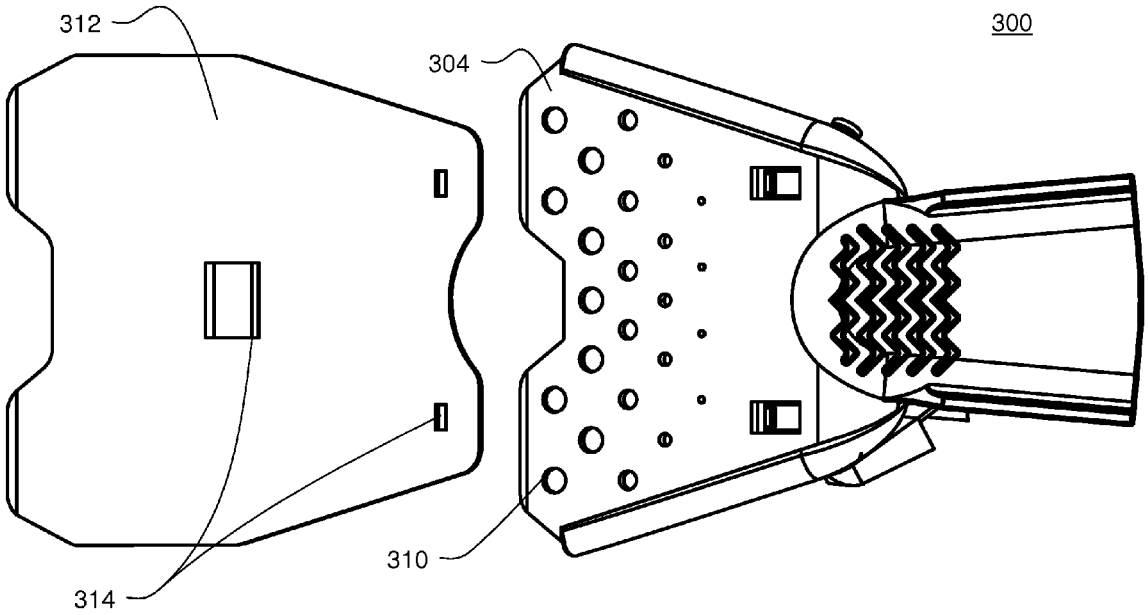

Referring to FIGS. 3 and 4, a second rear fin exemplary embodiment 300 has a removable heel fin 312 accessory. The removable heel fin 312 provides a removable extension fin. This exemplary embodiment may have a foot portion 302, a lateral fin 304, and rear side fins 306 as previous described in the first exemplary embodiment. In addition, the extension rear fins 312 provides additional surface area that allows a user to exert greater force from the user legs against the water. The extension rear fin 312 may be designed to extend further in a lateral direction, parallel with the lateral fin 304. The extension rear fin 312 may be designed to reduce or eliminate the flow of water through aperture/vents 310 of the lateral fin 304, thereby increase the forces transferred to the water and workout. A range of extension rear fin 312 may be supplied to the user to allow the user to modify the workout and performance of the aquatic gear. For example, a first extension may substantially eliminate the flow through the apertures/vents and extend substantially past the lateral fin and a second fin may reduce the flow through the apertures/vents and have a short length of extension relative to the first extension.

Clips 314 may be provided to allow the extension rear fin to be removably coupled to the lateral fin 304. The clip 314 may have a front grove that slide into slots on the lateral fin 304. A back lip portion may then provide a frictional fit with another slot on the lateral fin 304. The flexible material of the extension rear fins may allow the clips to snap together during installation of the extension rear fin 312. The extension rear fin 312 is not limited to the previously described clip system. The extension rear fin 312 may be, for example permanently coupled by adhesives, welds or other coupling methods. The extension rear fin 312 may also be removably coupled by, for example, clips, snaps, straps, or other temporary coupling methods.

Figure 5A:
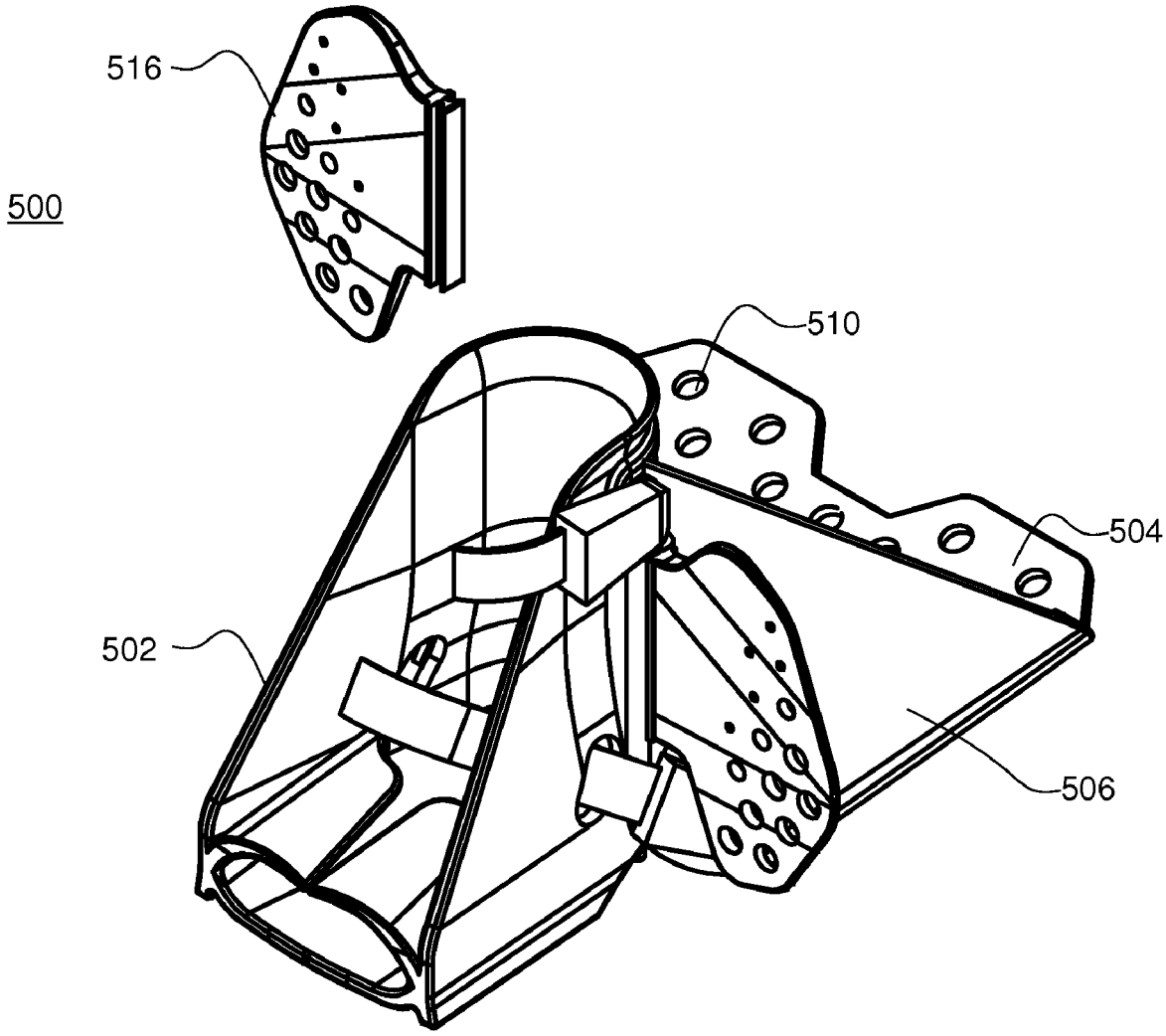
FIGS. 5A and 5B are a front and back perspective illustrating a third side fin exemplary embodiment according to the present invention.
Figure 5B:
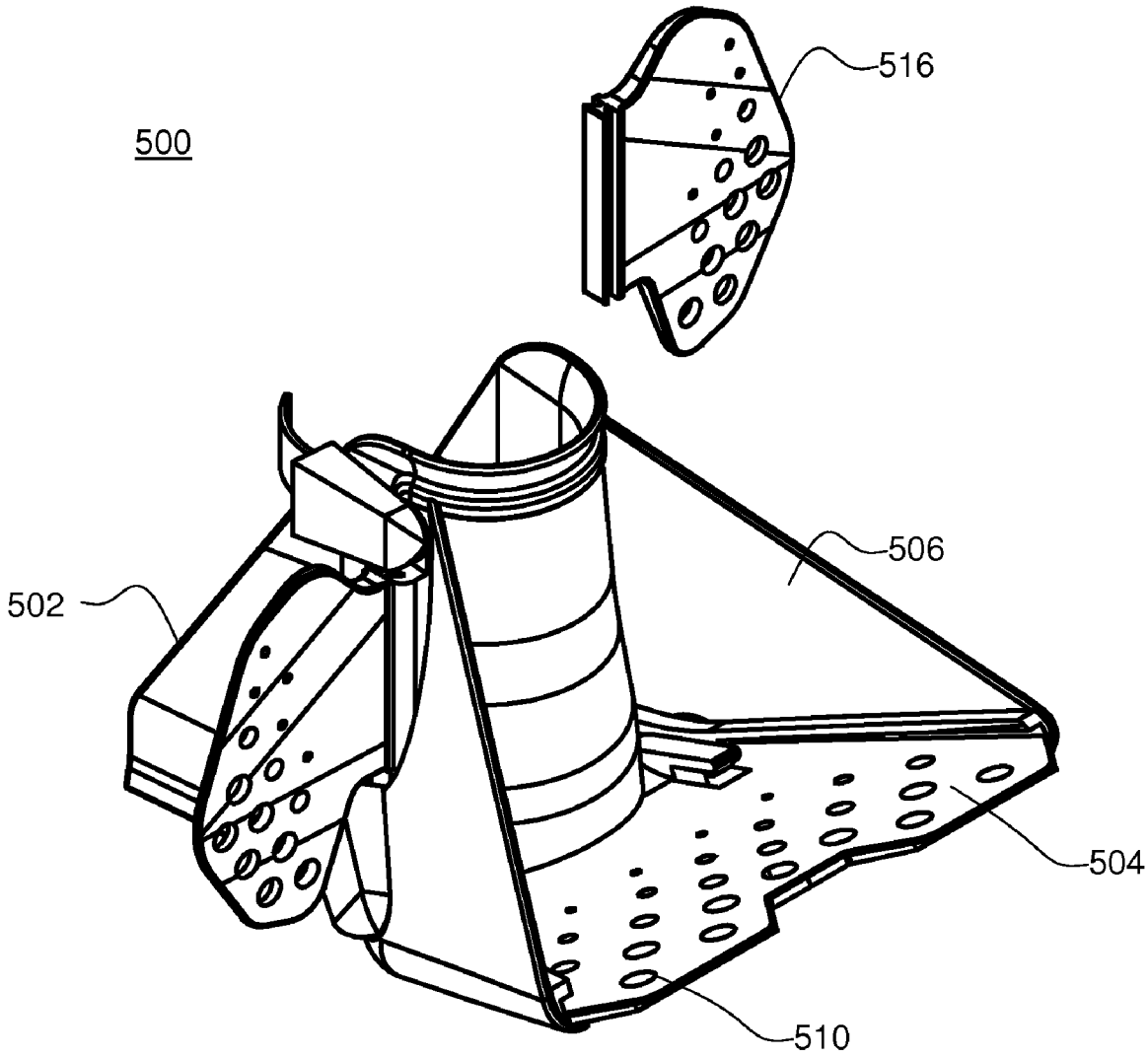
Figure 6A:
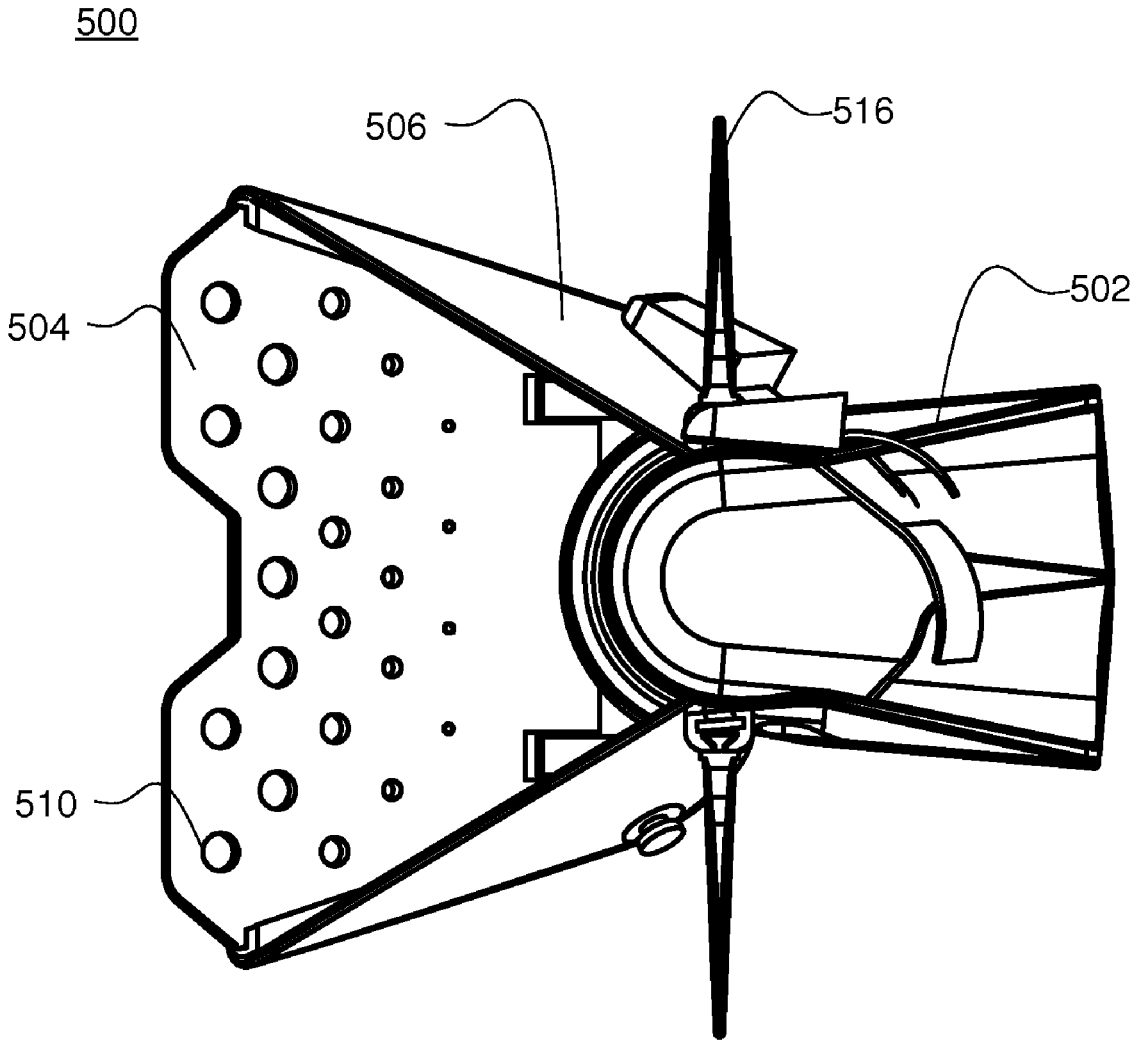
FIGS. 6A, 6B, and 6C are a top, side and bottom profile illustrating the third side fin exemplary embodiment according to the present invention.
Figure 6B:
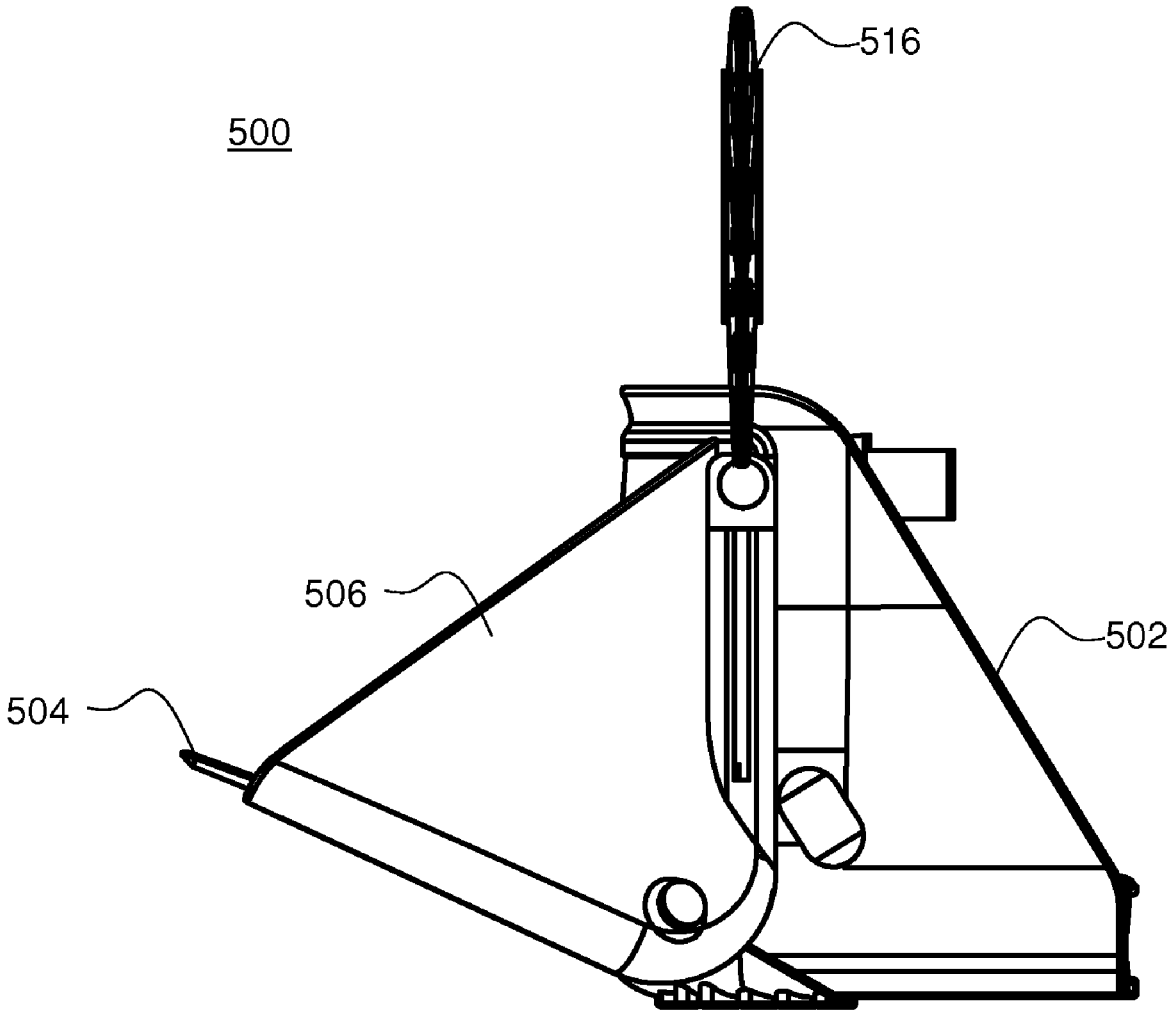
Figure 6C:
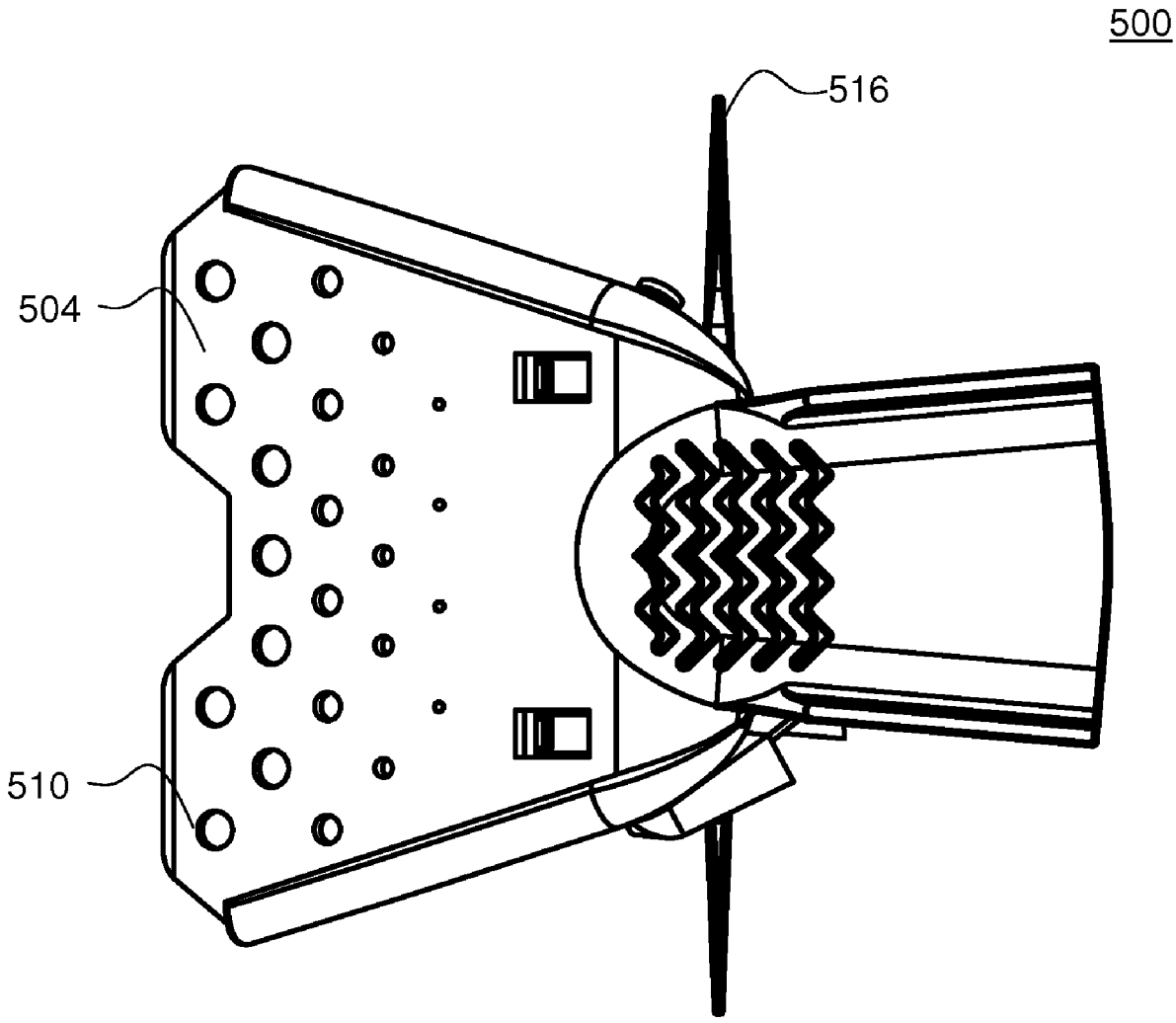

Referring to FIGS. 5 and 6, a third side fin exemplary embodiment 500 has removable side fin accessories. This exemplary embodiment may also have a foot portion 502, a lateral fin 504, and rear side fins 506 as previous described in the first exemplary embodiment. The side fins 516 provide additional surface area that allows a user to exert a different direction of force from the user legs against the water. This may allow the user to exercise different muscle groups and/or allow for greater stability/maneuverability in the water. The side fins 516 may extend out from an ankle region of the foot portion 502 and run horizontally along side the lower leg/ankle of the user.

The side fin 516 may be made of a semi-rigid rubber/plastic material. In one example, the side fins 516 may be designed to specifically flex in direction to the rear of the foot. As the user paddles the foot in a forward direction, water may push against the front surface of the side fin 516 allowing the side fin 516 to flex backwards and flatten. As the user moves their foot on the return stroke the water pushes on a back surface of the side fin 516. The side fins 516 straighten and apply surface area for the user leg to push water. The side fins 516 do not have to flex in a specific direction. The side fins 516 may be designed to be perpendicular and provide surface area against the water in both a forward and return stroke.

The side fins 516 may have a tong that allows the user to slide the tong into a slot on the side of the foot portion 502. This coupling allows the side fins to be removable. The user may remove the side fin 516 by moving the side fin 516 in an upward direction. The side fin 516 may be permanently coupled by, for example, adhesives, welds or other coupling methods. The side fins 516 may also be, for example removably coupled by clips, snaps, straps, or other temporary coupling methods. The side fins 516 are not limited to being on both sides of the foot portion. The user may use only one side fin to provide different motion and exercises.

The side fins 516 may have apertures and other vents 510 that allow water to flow through during paddling. The size of the apertures/vents 510 may be designed based on the desired force applied by the user to the water. For example, increasing the amount and size of vents 510 would decrease the strength to move the fin through the water but also decrease the amount of water displaced and therefore the force that propels the user. A range of side fins 516 may be supplied to the user to allow the user to modify the workout and performance of the aquatic gear. For example, a first set of side fins may not include the apertures/vents and/or a greater surface area while a second set of side fins may have several apertures/vents and/or a smaller surface area.

A method of using aquatic gear for a user's feet may involve the user coupling a foot portion for each flipper to a foot of a user. The user positions themselves into a reclined seated position in water. The user moves their feet in a paddling motion to propel the user in the direction of their feet. As user paddles, a lateral fin extended from the foot portion in driven forward during an extension period of the paddling motion and one or more rear side fins extending from a side edge of the lateral fin to the foot portion in a plane that intersects the lateral fin. The foot portion scoops the water during a return period of the paddling motion.

Figure 7:
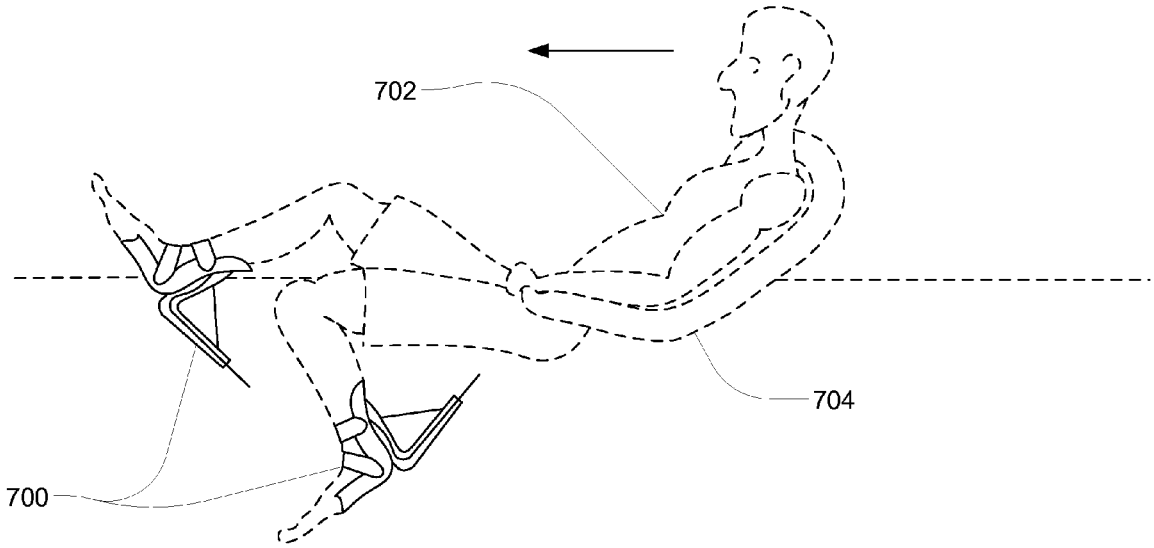
FIG. 7 is a profile illustrating an exemplary method of use embodiment according to the present invention.

Referring to FIG. 7, the aquatic gear 700 is coupled to the feet of a user 702. The user may be positioned in a reclined position. The float 704 may be used to help maintain the use's seated position. The user 702 moves their feet in a paddling motion to propel the user in the direction of arrow. The user is not limited to paddling to propel the user in the direction of their feet. The user is not limited to the above paddling method. For example, the user may use a bottom surface of the lateral fin to push water on the outward stroke of the legs and position the lateral fin in a parallel direction of movement on the return stroke. This method of paddle will propel the user in the direction of the user's head. The user may be positioned in a variety of position and may use the aquatic gear 700 to propel the user in a variety of directions.

Persons skilled in the art will also appreciate that the present invention can be practiced by other than the described previously described exemplary method, which are presented for purposes of illustration rather than of limitation and that the present invention is limited only by the claims that follow.

It will be understood that the foregoing is only illustrative of the principles of the invention and that various modifications can be made by those skilled in the art without departing from the scope and spirit of the invention. Accordingly, such embodiments will be recognized as within the scope of the present invention. Various aspects disclosed in the exemplary embodiments may be incorporated with aspects disclosed in other exemplary embodiments without departing from the scope of the invention.

The invention claimed is:

1. Aquatic gear for a user's feet comprising:

a foot portion adapted to receive a foot of a user;

a lateral fin extended from a heel end of a bottom surface of the foot portion in a direction away from a heel opposite a toe of the foot; and a first rear side fin and a second rear side fin, the first rear side fin extending along a first side edge of the lateral rear fin, running longitudinally, and coupling to the foot portion from the heel end of the foot portion to at least an ankle portion of the foot portion and the second rear side fin extending along a second, opposite side edge of the lateral rear fin, running longitudinally, and coupling to the foot portion from the heel end of the foot portion to at least an ankle portion of the foot portion.

2. The aquatic gear of claim 1, wherein the rear side fins are made of a flexible material and coupled to the foot portion and lateral fin to causes the rear side fin to flex when under compression and to be taught when under tension.

3. The aquatic gear of claim 1, wherein the foot portion receives the heel and further comprises one or more straps for coupling to an ankle/shin portion of the foot.

4. The aquatic gear of claim 1, further comprises one or more removable side accessory fins that extend from the foot portion in a plane that is substantially perpendicular to both a leg of the foot and a bottom surface of the foot.

5. The aquatic gear of claim 4, further comprises wherein each removable side accessory fin couples to the foot portion via a slot connection that runs in a direction parallel to a leg of the foot.

6. The aquatic gear of claim 4, wherein each removable side accessory fins has apertures that pass through the side accessory fin and allows the flow of water during use.

7. The aquatic gear of claim 1, wherein the lateral fin has apertures that pass through the lateral fin and allows the flow of water during use.

8. The aquatic gear of claim 7, further comprises a removable extension rear fin accessory that couples to the lateral fin and extends in a plane substantially parallel to the lateral fin wherein the removable extension rear fin blocks the flow of water through the apertures during use.

9. The aquatic gear of claim 1, further comprises a removable extension rear fin accessory that couples to the lateral fin and extends in a plane substantially parallel to the lateral fin.

10. The aquatic gear of claim 1, wherein the lateral fin extends in a plane that is angled between about 0-45 degrees from a plane of a bottom surface of the foot.

11. Paddling gear for a user's feet comprising:

a foot portion adapted to receive an ankle/shin and a heel portion of a foot of the user and having straps for securing the foot portion to the foot;

a lateral rear fin extended from a heel end of a bottom surface of the foot portion in a direction away from the heel opposite a toe of the foot and substantially parallel from the bottom surface of the foot; and a first rear side fin and a second rear side, the first rear side fin extending along a first side edge of the lateral rear fin, running longitudinally and coupling to the foot portion from the heel end of the foot portion to at least an ankle portion of the foot portion and the second rear side fin extending along a second, opposite side edge of the lateral rear fin running longitudinally and coupling to the foot portion from the heel end of the foot portion to at least an ankle portion of the foot portion wherein when the rear side fins are under compression the rear side fins flex increasing the angle of the lateral fin relative to plane of a bottom surface of the foot and when the rear side fins are under tension the rear side fins straighten decreasing the angle of the lateral fin relative to plane of a bottom surface of the foot.

12. The paddling gear of claim 11, further comprises one or more removable side accessory fins that extend from the foot portion in plane that is substantially perpendicular with a leg of the foot and a bottom surface of the foot.

13. The paddling gear of claim 11, wherein the lateral fin has apertures that passes through the lateral fin and allows the flow of water during use.

14. The paddling gear of claim 11, further comprises a removable extension rear fin accessory that couples to the lateral fin and extends in a plane substantially parallel to the lateral fin.

15. The paddling gear of claim 11, wherein the lateral fin extends in a plane that is angled between about 0-45 degrees from a plane of a bottom surface of the foot.

16. The paddling gear of claim 11, wherein the paddling gear is used for physical therapy.

17. Paddling gear for a user's feet comprising:

a foot portion adapted to receive an ankle/shin and a heel portion of a foot of the user and having straps for securing the foot portion to the foot;

a lateral rear fin extended from the foot portion in a direction away from the heel opposite a toe of the foot at an angle from a bottom surface of the foot;

two rear side fins extending from each side edge of the lateral fin to the foot portion in a plane that intersects the lateral fin and the foot portion wherein the rear side fin is made of a flexible material and coupled to the foot portion and lateral fin portion and wherein when the rear side fins are under compression the rear side fins flex increasing the angle of the lateral fin relative to plane of a bottom surface of the foot and when the rear side fins are under tension the rear side fins straighten decreasing the angle of the lateral fin relative to plane of a bottom surface of the foot; and a removable extension rear fin accessory that couples to the lateral fin and extends in a plane substantially parallel to the lateral fin.

18. The paddling gear of claim 17, further comprises one or more removable side accessory fins that extend from the foot portion in plane that is substantially perpendicular with a leg of the foot and a bottom surface of the foot.

19. The paddling gear of claim 17, wherein the lateral fin has apertures that passes through the lateral fin and allows the flow of water during use.

20. The paddling gear of claim 17, wherein the lateral fin extends in a plane that is angled between about 0-45 degrees from a plane of a bottom surface of the foot.

* * * * *